United States Patent [19]

Marten et al.

[11] Patent Number: 5,019,606

[45] Date of Patent: May 28, 1991

[54] AQUEOUS SOLUTIONS OF POLYAMIDOAMINE-EPICHLOROHYDRIN RESINS, AND PREPARATION AND USE THEREOF

[75] Inventors: Manfred Marten, Mainz; Walter Kamutzki, Dieburg, both of Fed. Rep. of Germany

[73] Assignee: Hoechst AG, Fed. Rep. of Germany

[21] Appl. No.: 374,467

[22] Filed: Jun. 30, 1989

[30] Foreign Application Priority Data

Jul. 2, 1988 [DE] Fed. Rep. of Germany ..... 3822490

[51] Int. Cl.[5] ..... C08K 63/00

[52] U.S. Cl. ..... 523/414; 523/416; 523/417; 523/418

[58] Field of Search ..... 523/416, 417, 418, 414, 523/420; 524/538; 528/341

[56] References Cited

U.S. PATENT DOCUMENTS

| | | | |
|---|---|---|---|
| 3,240,761 | 3/1966 | Keim et al. | 528/341 |
| 3,332,901 | 7/1967 | Keim | 528/341 |
| 3,647,763 | 3/1972 | Stockmann et al. | 528/341 |
| 4,075,177 | 2/1978 | Bonnet et al. | 525/430 |
| 4,336,835 | 6/1982 | Takagishi et al. | 428/479.6 |
| 4,579,667 | 4/1986 | Echt et al. | 523/414 |
| 4,847,315 | 7/1989 | Hassler | 528/341 |
| 4,870,119 | 9/1989 | Yee et al. | 523/417 |

*Primary Examiner*—Paul R. Michl
*Assistant Examiner*—Christopher P. Rogers
*Attorney, Agent, or Firm*—Bierman and Muserlian

[57] ABSTRACT

Aqueous solutions of polyamidoamine-epichlorohydrin resins and preparation and use thereof.

A stable aqueous resin solution having a pH of not more than 7 and containing as the resin a water-thinnable polyamidoamine-epichlorohydrin resin (A) obtained by reaction of a water-thinnable basic polyamidoamine (B) comprising an acid component ($B_1$) and an amine component ($B_2$) with epichlorohydrin (C), the level of organically bound chlorine in the resin (A) being not more than 4% by weight.

The present invention further relates to a process for preparing these products and to the use thereof in particular for increasing the wet strength of paper.

6 Claims, No Drawings

AQUEOUS SOLUTIONS OF POLYAMIDOAMINE-EPICHLOROHYDRIN RESINS, AND PREPARATION AND USE THEREOF

DE Auslegeschrift No. 1,177,824 discloses reacting polyamines which have three or more amino groups with $C_3$–$C_{10}$-dicarboxylic acids and converting the resulting polyamides with epichlorohydrin into water-soluble condensation products. For the conversion, the epichlorohydrin can be used in a molar ratio of from about (0.5 to 1.8):1 to the secondary amino groups of the polyamide. The products obtained can be used for improving the wet strength of paper.

It is also known (for example from British Pat. No. 865,727) that such aqueous condensation products from polyamidoamines and epichlorohydrin contain inter alia chlorohydrin structural units of the formula

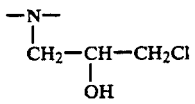

Consequently, polyamidoamine-epichlorohydrin resins can contain an appreciable amount of organically bound chlorine. However, environmental protection legislation now requires that products must not own more than the minimal organically bound chlorine content.

U.S. Pat. No. 3,352,833 describes inter alia an alkaline aftertreatment of polyamidoamine-epichlorohydrin resins for reactivating the wet strength activity, where the acidified resin solutions are made to react with 0.25 to 2.5 equivalents of base per equivalent of acid in an aqueous solution. According to Example 10 of said U.S. Pat. No. 3,352,833, the base is added before the resin is used for papermaking, and the resin solution is aged for four hours and then used at once. There is no mention of the degradation of the organically bound chlorine in these publications. However, repeating the alkaline aftertreatment specified in this U.S. patent shows that it does not produce sufficiently stable and/or sufficiently low-chlorine resin solutions (cf. the comparative tests below). A further disadvantage of this alkali activation prior to processing, for example in the paper stock, is the addition of equipment required by this method, such as vessels, stirrers and metering means. For the optimal use of the polyamidoamine-epichlorohydrin resins to be activated under alkaline conditions it is also necessary to meter the added alkali exactly, to adhere to certain aging times, and, owing to a reduction in the stability of the alkaline solution which occurs, to use this solution within a certain time.

The present invention now provides a stable aqueous resin solution having a pH of not more than 7 and containing as the resin a water-thinnable, preferably water-soluble polyamidoamine-epichlorohydrin resin (A) obtained by reaction of a water-thinnable, preferably water-soluble, basic polyamidoamine (B), comprising an acid component ($B_1$) and an amine component ($B_2$), with epichlorohydrin (C), the level of organically bound chlorine in the resin (A) being not more than 4% by weight.

The present invention further provides a process for preparing these resin solutions and the use thereof.

The attribute "stable" is here intended to mean that during a storage period of at least three months at room temperature (or at least 10 days at 50° C.) there is no sign of gelling or precipitation.

The term "solution" here is also intended to include a colloidal solution.

The pH of the resin solution according to the invention is preferably between 1.5 and 5. The viscosity of a 12.5% solution at 25° C. is in general about 10 to 200, preferably 15 to 80, mPa.s.

The level of resin (A) in the solution according to the invention is in general between 8 and 25% by weight, preferably 10 and 15% by weight, based on the solution.

In addition, this resin solution contains small amounts of inorganic substances (from the base treatment and the subsequent neutralization) and optionally up to 0.5% by weight, preferably 0.05 to 0.2% by weight, of fungicides, such as sorbic acid or potassium sorbate, and further optional additives, for example antifoams.

Resin (A) has in general an average molecular weight $\overline{M}_n$ of at least 500, preferably of at least 1,000, in particular of 1,000 to 500,000. The level of organically bound chlorine is in general between 0.1 and 4, preferably between 1 and 4, in particular between 1 and 3, % by weight. In a 12.5% strength resin solution this chlorine content does not exceed values of 0.5% by weight and is in general between 0.0125 and 0.5, preferably between 0.125 and 0.5, in particular between 0.125 and 0.375, % by weight, based on the solution.

The amount of units in (A) derived from epichlorohydrin is in general 20 to 50% by weight, preferably 30 to 40% by weight, based on (A).

The novel process for preparing above-described resin solutions comprises reacting water-soluble basic polyamidoamines (B) with epichlorohydrin (C) in a ratio of 0.6 to 2 moles per mole of basic amino groups of polyamidoamine (B) in an aqueous system and then, if necessary after prior acidification of the reaction system, reacting with a sufficient amount of a base (D), in general 0.1 to 1.0 mole, preferably 0.1 to 0.6 mole, per mole of epichlorohydrin used at 25 to 95° C. that the pH is greater than 8, and subsequently adjusting the pH by addition of acid to not more than 7.

The water-soluble polyamidoamine (B) has in general an average molecular weight $\overline{M}_n$ (determined via the carboxyl end groups, of at least 500, preferably at least 1,000 and in particular 2,000 to 20,000; the amine number is usually between 200 and 400, preferably between 250 and 350, mg of KOH/g, and the acid number between 0 and 50, preferably between 10 and 30, mg of KOH/g.

Polyamidoamines (B) which meet the conditions according to the invention are described for example in DE-B-No. 1,777,824, GB Pat. No. 865,727, U.S. Pat. Nos. 4,075,177 and 4,336,835, DE-A-No. 3,323,732 and EP-A-No. 31,899, which are hereby incorporated herein by reference. Of the products mentioned, it is the products described in DE-A-No. 3,323,732 which are preferred, provided they fall within the present scope.

In general, such polyamidoamines (B) are obtained by reacting the acid component ($B_1$), such as dicarboxylic acids or functional derivatives thereof or ω-aminocarboxylic acids or lactams thereof, with the amine component ($B_2$), such as polyamines. Preferably this component ($B_2$) comprises a mixture of polyamines and alkanolmonoamines if the acid component ($B_1$) is an aliphatic or aromatic carboxylic acid or a functional derivative thereof, with or without an aminocarboxylic acid or a lactam thereof. The abovementioned polyamines contain two or more primary amino groups and preferably one or more secondary or tertiary amino groups. The mixing ratio of these components has to be chosen in such a way that the resulting polyamidoamine (B) still has a sufficient number of basic (i.e. reactive with epichlorohydrin (C)) amino groups, no gelling occurs in the course of the reaction and the molecular weight of (A) is within the stated range.

The polyamidoamines (B) are for example reaction products of (a) saturated or olefinically unsaturated aliphatic $C_3$–$C_{10}$-dicarboxylic acids or functional derivatives thereof or ω-aminocarboxylic acids of 3 or more carbon atoms or lactams thereof with (b1) aliphatic polyamines which contain two or more primary and one or more further, secondary and/or tertiary amino groups, or (b2) a mixture of polyamines (b1) with (c1) polyamines which contain one or more primary and, optionally, one or more secondary amino groups and do not fall within definition (b1), the additional polyamines being used in such amounts that their contribution of primary amino groups, based on the total amount of primary amino groups, does not exceed 70%, preferably 50%, and in particular 30%, and/or (c2) alkanolmonoamines of 2 to 20 carbon atoms, preferably 2 to 6 carbon atoms, and 1 to 3, preferably 1 or 2, OH groups, in particular one OH group. Preferably, these alkanolmonoamines have the formula (II) indicated hereinafter.

Suitable water-soluble polyamidoamines (B) are in particular:

Reaction products of (a) saturated aliphatic $C_3$–$C_{10}$-dicarboxylic acids, such as succinic acid, glutaric acid, adipic acid, sebacic acid, malonic acid or functional derivatives thereof, such as anhydrides and esters, the first three acids being preferred, with the polyamines mentioned above under $(b_1)/(c_1)$, preferably from a mixture with alkanolmonoamines.

2. Reaction products of those saturated modified dicarboxylic acids or derivatives thereof, which are obtained by addition of aliphatic, cycloaliphatic, araliphatic or heterocyclic polyamines with two or more primary and/or secondary amino groups onto α,β-olefinically unsaturated carboxylic esters whose alcohol radical has 1 to 8, preferably 1 to 3, carbon atoms, such as ethyl acrylate or methyl methacrylate, and are then reacted with the polyamines mentioned above under $(b_1)/(c_1)$ or mixtures thereof, preferably mixtures with alkanolmonoamines.

3. Reaction products of ω-aminocarboxylic acids containing three or more carbon atoms or lactams thereof, for example 6-aminocaproic acid and 8-aminocaprylic acid or 6-caprolactam and 8-caprylactam, with the $(b_1)/(c_1)$ polyamines or mixtures thereof, preferably with alkanolmonoamines.

4. Reaction products of olefinically unsaturated dicarboxylic acids, such as maleic acid or fumaric acid, or functional derivatives thereof, such as anhydrides or esters, with the polyamines mentioned above under $(b_1)/c_1)$, or mixtures thereof, preferably with alkanolmonoamines.

5. Those reaction products which are based not only on the saturated aliphatic $C_3$–$C_{10}$-dicarboxylic acids mentioned under 1. and the unsaturated dicarboxylic acids mentioned under 4. but also on ω-aminocarboxylic acids or lactams thereof of the type mentioned under 3. and not only on the polyamines mentioned under (b1) but also on aliphatic, cycloaliphatic, araliphatic or heterocyclic polyamines which contain at least one primary and optionally a secondary amino group, i.e. for example a primary or a secondary amino group, and alkanolamines. Preference is given to those polyamidoamines which are based not only on the polyamines mentioned above under $(b_1)/c_1)$ or mixtures thereof, preferably with alkanolmonoamines, and not only on the saturated $C_3$–$C_{10}$-dicarboxylic acids but also on ω-aminocarboxylic acids or lactams thereof of the type mentioned under 3.

Reaction products of type (1) using diethylenetriamine, triethylenetetramine and tetraethylenepentamine as polyamine and 2-aminoethanol as alkanolmonoamine are particularly preferred.

Suitable polyamines (b1) and (c1) are for example those of the formula (I)

$$H_2H-(R_1\overset{\overset{R_2}{|}}{N})_p-R_{2'} \qquad (I)$$

where p is zero or an integer from 1 to 6, preferably 1 to 4, $R_1$ is a divalent, preferably nonaromatic hydrocarbon radical of 2 to 18 carbon atoms, preferably a branched or unbranched alkylene radical of 2 to 10 carbon atoms, in particular 2 to 6 carbon atoms, or a cycloalkylene radical of 5 to 12 carbon atoms and preferably 6 to 10 carbon atoms, or an aralkylene radical of 7 to 12 carbon atoms, preferably 8 to 10 carbon atoms, $R_2$ and $R_{2'}$ are independently of each other H or one of the two radicals is $$-R_1-N\begin{matrix}\diagup R_3\\ \diagdown R_4\end{matrix}$$

where R is as defined above, and $R_3$ and $R_4$ are independently of each other H or $(C_1$–$C_{20})$alkyl, preferably $(C_1$--$C_6)$alkyl, which alkyl radicals may also carry hydroxyl groups.

Examples of polyamines (b1) are: methylbis(3-aminopropyl)amine, ethylbis(3-aminopropyl)amine, N(3-aminopropyl)tetramethylenediamine, N,N'-bis(3-aminopropyl)tetramethylenediamine, polyalkylenepolyamines, such as dipropylene(1,2)triamine, bis(3-aminopropyl)amine, tripropylene(1,2)tetramine and in particular diethylenetriamine, triethylenetetramine and tetraethylenepentamine.

Polyamines (c1) are for example: ethylenediamine, propylenediamine, 1-amino-3-methylaminopropane, 2-methylpentamethylenediamine, pentaethylenediamine, hexamethylenediamine, trimethylhexamethylenediamine, neopentyldiamine, octamethylenediamine, dioxadodecanediamine, cycloaliphatic diamines such as 1,2-, 1,3- or 1,4-cyclohexanediamine; 4,4'-methylene-bis-cyclohexylamine, isophoronediamine, menthanediamine, 4,4'-diamino3,3'-dimethyldicyclohexylmethane, 3-aminomethyl-1-(3-aminopropyl-1-methyl)-4-methylcyclohexane, N-methylethylenediamine, N-aminoethylpiperazine and 1,3-bis-aminomethylbenzene.

Suitable alkanolmonoamines are for example those of formula $$H_2N\text{-}R_1\text{-}OH \quad (II)$$

where $R_1$ is as defined above, such as 2-aminoethanol, 1-amino-2-propanol, 3-amino-1-propanol, 2-amino-1-butanol, 4-amino-1-butanol, 5-amino-1-pentanol, 6-amino-1-hexanol and isomers thereof whose hydrocarbon radical is branched or which carry the amino group and/or the hydroxyl group on a primary or secondary carbon atom, and those which are derived from cyclic hydrocarbon radicals, preferably of 5-7 carbon atoms.

The mixing ratios between the components in question which must be maintained to obtain water-soluble polyamidoamines (B) having optimal properties are easily determinable by preliminary experiments. In general, the molar amount of dicarboxylic acid or functional derivatives thereof to polyamine/alkanolmonoamine is such that the ratio of carboxyl groups to the sum of primary $NH_2$ groups is 1: (0.8–1.4), preferably 1: (0.95–1.1). In the case of mixtures of polyamines and alkanolmonoamines the ratio of their molar amounts is 0.6:0.4 to 0.99:0.01, preferably 0.8:0.2 to 0.95:0.05.

The polyamidoamines (B) can be prepared in a conventional manner, for example by heating the corresponding components at temperatures of 125° to 250° C., preferably 140° to 180° C., for several hours in the absence of oxygen, initially under atmospheric pressure and then under reduced pressure, in the presence of a small amount of hydrazine hydrate or hydrazides added if desired to avoid the darkening of the polyamides. The reaction time depends on the temperatures and pressures employed and is in general between 4 and 10 hours.

In place of the epichlorohydrin (C) it is also possible to use if desired the dichlorohydrin (1,3-dichloro-2-hydroxypropane).

Suitable bases (D) are inter alia: alkali metal hydroxides, preferably sodium hydroxide or potassium hydroxide, carbonates, bicarbonates, alkaline earth metal hydroxides, such as calcium hydroxide, and also benzyltrimethylammonium hydroxide, tetramethylammonium hydroxide, tetraethylammonium hydroxide or mixtures thereof.

The reaction products can be prepared by the process of the invention by reacting the polyamidoamines (B) and epichlorohydrin (C) in a first reaction step at a concentration of the reactants of about 25 to 50%, preferably 35 to 45%, and at a temperature of between 25° 95° C., preferably 40° to 70° C., until the viscosity of a 40% strength solution (determined at 25° C.) is about 100 to 600, preferably 200 to 400, mPa.s. Thereafter this solution is reacted in a second reaction step with an aqueous solution of a base (D) present in an amount of in general 0.1 to 1.0, preferably 0.1 to 0.6, mole per mole of epichlorohydrin (C) used at a concentration of reactants of 10 to 40%, preferably 15 to 25%, and at a temperature of between 25° and 95° C., preferably 40° to 70° C., until the viscosity of a 12.5% strength solution (determined at 25° C.) is 10–200 mPa.s, preferably 15 to 80 mPa.s. The pH in the second reaction step is greater than 8, preferably between 9 and 12. Thereafter the mixture has advantageously added to it, to terminate the action and to stabilize the inherently self-crosslinking reaction products, sufficient acid or acid derivatives that the pH of the aqueous solution is 1 to 7, preferably between 1.5 and 5, and the solids content of the reaction solution is adjusted to 8–25% by weight by dilution with water.

In another, less preferred embodiment, acid can be initially added to the solution during or after the reaction of polyamidoamine (B) and epichlorohydrin (C) to adjust the pH to less than 7, preferably 1.5 to 5. This acid reaction mixture is then admixed with sufficient base (D) so that the pH is greater than 8, preferably between 9 and 12, and this system is then maintained at a temperature of 25° to 95° C., preferably 40° to 70° C., for a period of 0.5 to 8 hours, preferably 1 to 4 hours.

Possible acids are in particular halogen-free acids, such as sulfuric, phosphoric or acetic acid, and suitable acid derivatives are corresponding anhydrides or acidic salts.

The amount of epichlorohydrin (C) is in general 0.6 to 2 moles, preferably 1.0 to 1.4 moles, per mole of basic amino groups (primary, secondary or tertiary) in polyamidoamine (B), and the amount of base (D) is 0.1 to 1.0 mole, preferably 0.1 to 0.6 mole, per mole of epichlorohydrin used.

The resins or resin solutions according to the invention have an appreciably lower organically bound chlorine content than the prior reaction products from polyamidoamine and epichlorohydrin and therefore are highly suitable for significantly reducing the organic chlorine content of waste waters, inter alia from paper factories. This useful property is not possessed to the same extent by the reaction products hitherto used for improving the wet strength of paper. Owing to the long shelf life of the resin solutions according to the invention, their wet strength activity is constant even after months of storage.

By means of the reaction products prepared by the process according to the invention it is possible to obtain excellent improvements in the wet strength of paper —including paper made of unbleached pulp. In some cases it is also possible, depending on the type of paper or if desired, to increase the absorbancy. It is to be noted that the reaction products virtually do not impair the whiteness of paper made from bleached pulp. It may further be mentioned that the rate at which the reaction products to be used according to the invention undergo crosslinking on the paper or in the cellulose is high and that the reaction products can also be used as retention aids for fillers used in papermaking, as drainage aids for improving the rate of paper formation, and as flocculants for removing fine particles from dirty water, for example industrial waste water.

To increase the wet strength of paper in accordance with the present invention, a possible procedure is for example to add the resins in question in the form of aqueous solutions to the aqueous suspension of the paper raw material even before the processing into paper. The amounts of resin required for obtaining the desired wet strength are determinable without difficulty by preliminary experiments. In general, it is advisable to use 0.05 to 2, preferably 0.1 to 1.6, parts by weight of solid resin per 100 parts by weight of paper raw material, advantageously in the form of an aqueous solution whose reaction product content is 8 to 25, preferably 10 to 15, % by weight.

The Examples which follow are intended to illustrate the invention in more detail. Percentages are by weight, unless otherwise stated. The organic chlorine content was determined as the difference of the chlorine content determined by the combustion method of Wickbold (reference standards: DIN 53 188, section 13, and DIN 53 474, sections 5.5 and 6.3) and the ionic chlorine content.

EXAMPLES

1. Preparation of polyamidoamine (B)

392 g of diethylenetriamine (3.8 mol) and 24.4 g (0.4 mol) of 2-aminoethanol were introduced into a four-necked flask equipped with a stirrer, a thermometer and a distillation apparatus, and 584 g of adipic acid (4 mol) were added over 30 minutes a little at a time, so that the temperature did not rise above 100° C. The mixture was then heated to 150° C. under nitrogen over 3 hours, maintained at that temperature for one hour and further heated to 170° C., while the water formed distilled over at a uniform rate. After a holding time of about 2 hours the condensate had an acid number of 20 mg of KOH/g and an amine number of 251 mg of KOH/g. After the heating had been removed, the polyamidoamine was diluted with 570 g of water. The solution had a solids content of 59.8% (1 g, 1 hour, 125° C.) and a viscosity at 25° C. of 1174 mPa.s.

2. Preparation of a polyamidoamine-epichlorohydrin resin (Comparison)

(a) 322 g of the polyamidoamine intermediate solution of Example 1 (corresponding to 0.857 eq of NH) and 321 g of water were introduced into a three-necked flask equipped with a stirrer, a thermometer and a condenser, and 111 g of epichlorohydrin (1.20 mol) were added with stirring. The mixture was heated to 55–60° C. in the course of 30 minutes and maintained at that temperature. After 6 hours the Gardner viscosity was I.

(b) 352 g of water were added, heated to 60°–65° C. and maintained at that temperature. After 3 hours the Gardner viscosity was F. 1295 g of water in which 2.5 g of potassium sorbate had been dissolved were then added, and the resin solution was cooled. It was then brought to pH 3.70 with 14 g of 48% strength sulfuric acid. The resin solution had a solids content of 12.6% (1 g, 1 hour, 100° C.) and a viscosity at 25° C. of 21 mPa.s.

3. Preparation of a polyamidoamine-epichlorohydrin resin (Comparison)

(a) 207 g of the polyamidoamine intermediate solution of Example 1 (corresponding to 0.552 eq. of NH) and 207 g of water were introduced into a three-necked flask equipped with a stirrer, a thermometer and a condenser, and 66.5 g of epichlorohydrin (0.72 mol) were added with stirring. The temperature was raised to 60° C. in the course of 60 minutes and maintained at that level. After 3 hours the Gardner viscosity was M.

(b) 578 g of water were added, and the temperature was raised to 65° C. and maintained at that level. After 4 hours the Gardner viscosity was F-G. 442 g of water in which 1.5 g of potassium sorbate had been dissolved was then added, the resin solution was cooled. It was then brought to pH 3.9 with 9.2 g of 48% strength sulfuric acid. The resin solution had a solids content of 12.6% (1 g, 1 hour, 100° C.) and a viscosity at 25° C. of 47 mPa.s.

4. Preparation of a polyamidoamine-epichlorohydrin resin (Comparison)

(a) Initially Example (2a)/(b) was repeated, but the dilution with water in stage (b) was to about 20%. The resulting resin solution had the following data:

| | |
|---|---|
| Solids content (1 g, 1 h, 100° C.) | 19.7% |
| pH | 4.01 |
| Viscosity 25° C. | 46.5 mPa.s |
| Stability 50° C. | >10 days |
| Chlorine total calculated | 2.84% |
| Chlorine ionic found | 1.67% |

200 g of this resin solution contained:

| | |
|---|---|
| 4.7 g of epichlorohydrin | 158.9 meq |
| 0.793 g of $H_2SO_4$ 100% | 16.2 meq |

(b) In line with the teaching of claim 11 of U.S. Pat. No. 3,352,833, 200 ml of the resin solution described in (a) were reacted at room temperature with 4.1 ml of 10 N NaOH (corresponding to 2.5 equivalents of NaOH per equivalent of $H_2SO_4$) for 4 hours. The results are shown in Table 2.

(c) The alkali treatment was carried out as described in section (b), except that the alkali was used in an amount corresponding to Example 10 of U.S. Pat. No. 3,352,833, namely 17.5 ml of 10N NaOH per 200 g of resin solution (=equivalent to the total amount of epichlorohydrin and $H_2SO_4$). For the results, again see Table 2.

5. Preparation of a polyamidoaminc-epichlorohydrin resin (Comparison)

(a) Initially Example (3a)(/b) was repeated; the resulting resin solution had the following data:

| | |
|---|---|
| Solids content (1 g, 1 h, 100° C.) | 12.4% |
| pH | 3.99 |
| Viscosity 25° C. | 33.9 mPa.s |
| Stability 50° C. | >10 days |
| Chlorine total calculated | 1.69% |
| Chlorine ionic found | 1.07% |

200 g of this resin solution contained:

| | |
|---|---|
| 8.81 g of epichlorohydrin | 95.2 meq |
| 0.557 g of $H_2SO_4$ 100% | 11.4 meq |

(b) As in (4b), 200 g of the above resin solution were reacted with 2.85 ml of 10N NaOH (2.5 equivalents/equivalent of $H_2SO_4$) at room temperature for 4 hours. Results see Table 2.

(c) As in Example (4c), 200 g of the above resin solution were reacted with 10.7 ml of 10N NaOH (=equivalent to the total amount of epichlorohydrin and $H_2SO_4$). For the results, see Table 2.

6. Preparation of a polyamidoamine-epichlorohydrin resin (According to the invention)

(a) 207 g of the polyamidoamine intermediate solution of Example 1 (corresponding to 0.552 eq. of NH) and 207 g of water were introduced into a three-necked flask equipped with a stirrer, a thermometer and a condenser, and 66.5 g of epichlorohydrin (0.72 mol) were added with stirring. The temperature was raised to 60° C. in the course of 45 minutes and maintained at that level. After 3.5 hours the Gardner viscosity was N.

(b) 578 g of 1% strength sodium hydroxide solution were added, and the mixture was heated to 65° C. and maintained at that temperature. After 3 hours the Gardner viscosity was E-F. 442 g of water in which 1.5 g of potassium sorbate had been dissolved were then added, and the resin solution was cooled and then brought to pH 3.9 with 11.7 g of 48% strength sulfuric acid. The resin solution had a solids content of 12.7% (1 g, 1 hour, 100° C.) and a viscosity at 25° C. of 39 mPa.s.

PREPARATION OF FURTHER RESINS (A) BY THE METHOD OF EXAMPLE 6

The method of Example 6 was employed with varying amounts of sodium hydroxide to prepare the following additional products:

7. In reaction step (b), 578 g of 1.5% strength sodium hydroxide solution were added. Acidification was effected with 24.9 g of 48% strength sulfuric acid to a pH 1.75. The resin solution obtained had a solids content of 13.3% (1 g, 1 hour, 100° C.) and a viscosity at 25° C. of 34 mPa.s.

8. In reaction step b), 578 g of 2.0% strength sodium hydroxide solution were added. Acidification was effected with 37.5 g of 48% strength sulfuric acid to a pH 1.75. The resin solution obtained had a solids content of 13.5% (1 g, 1 hour, 100° C.) and a viscosity at 25° C. of 40 mPa.s.

PAPER TREATMENT

To 2 kg of a suspension of 10 g of bleached sulfite cellulose having a freeness of 42° to 43° Schopper-Riegler were added with vigorous stirring the 12.5% strength aqueous resin solutions of Examples 2, 3, 6, 7 and 8 in an amount of 1% of solid resin on cellulose.

Following an absorption time of at least 2 minutes, a Schopper sheet former was used to form two sheets of paper approximately 320 $m^2$ in area with a basis weight of 100 $g/m^2$, which were heated at 100° C. on a drying cylinder for 5 minutes and postcured in a drying cabinet at 120° C. for 10 minutes. Following a conditioning time of 24 hours at 20° C. and 65% relative humidity, the wet strengths in Newton (N) were measured on test strips of the paper in accordance with the test method of the Cellulose Institute of the Darmstadt College of Technology. The paper obtained in this manner had a wet strength considerably higher than that of a paper produced from the same bleached sulfite cellulose under the same experimental conditions without the addition of the aqueous solutions of the products used according to the invention.

The wet strengths in Newton (N) are given in relative %, based on comparative product 2=100%, in Table 1.

TABLE 1

| Example | Total chlorine content (%) | Organically bound chlorine (%) Ionic chlorine (%) | based on resin solution | based on resin (A) | Wet strength activity (%) | Shelf life at 50° C. in days |
|---|---|---|---|---|---|---|
| 2 (comparison) | 1.76 | 1.03 | 0.73 | 5.8 | 100 | >10 |
| 3 (comparison) | 1.69 | 1.10 | 0.59 | 4.7 | 100 | >10 |
| 6 | 1.69 | 1.33 | 0.36 | 2.8 | 99 | >10 |
| 7 | 1.69 | 1.40 | 0.29 | 2.2 | 100 | >10 |
| 8 | 1.69 | 1.56 | 0.13 | 1.0 | 99 | >10 |

Table 1 shows that, compared with Comparative Examples 2 and 3, the level of organically bound chlorine in Examples 6 to 8 is distinctly reduced, in Example 8 the value being only about 20% of that of Comparative Example 3. Moreover, the reaction products prepared by the process according to the invention show excellent wet strength activities and long shelf lives.

TABLE 2

| | 4b | 4c | 5b | 5c |
|---|---|---|---|---|
| Resin | 4a | 4a | 5a | 5a |
| Resin solution (g) | 200 | 200 | 200 | 200 |
| Total chlorine (%) | 2.84 | 2.84 | 1.69 | 1.69 |
| $Cl^-$ (%) | 1.67 | 1.67 | 1.07 | 1.07 |
| 10 N NaOH ml | 4.1 | 17.5 | 2.85 | 10.7 |
| pH | 9.9 | 12.7 | 10.5 | 12.5 |
| $Cl^-$ after 1 h (%) | 1.97 | 2.23 | 1.24 | 1.41 |
| $Cl^-$ after 4 h (%) | 1.97 | 2.31 | 1.26 | 1.43 |
| $Cl^-$ after 24 h (%) | 1.97 | gelled | 1.27 | gelled |
| Level of organically bonded chlorine (%) based on solution* | 0.87 | — | 0.42 | |
| Shelf life at 50° C. | >10 days | 1.5 h | >10 days | 3 h |

*after 24 h

This Table shows that the products obtained by 4c/5c lead to a decrease in the organically bound chlorine content (increase in $Cl^-$), but do not have a sufficiently long shelf life (gel formation after 24 h).

By contrast, the products obtained by 4b/5b are still stable after 10 days (50° C.). However, the increase in the $Cl^-$ content is distinctly less than that in the resins according to the invention. In the case of resin (5b) the level of organically bound chlorine comes out as 0.42%; in Examples 6, 7 and 8 according to the invention, the level of organically bound chlorine is lower than this value.

These experiments show that the process described in U.S. Pat. No. 3,352,833 does not give stable products low in organically bound chlorine as are provided by the process according to the invention. This confirms what is known from the prior art. The processing of alkali-activated resins must take place with accurate alkali metering within a certain period, which is felt to be a considerable disadvantage in practice.

We claim:

1. A process for preparing a stable aqueous resin solution having a pH of not move than 7 and containing as the resin a water-thinnable polyamidoamine-epichlorohydrin resin (A), which comprises reacting watersoluble basic polyamidoamines (B) with epichlorohydrin (C) molar ratio of 0.6 to 2 in an aqueous system and then, optionally after a prior acidification of the reaction system, reacting with a sufficient amount of the base (D) at 25° to 95° C. so that the pH is greater than 8, and subsequently adjusting the pH to not more than 7 by addition of acid.

2. The process as claimed in claim 1, wherein the amount of base is 0.1 to 0.6 mole per mole of epichlorohydrin used.

3. The process as claimed in claim 1, wherein the base used is sodium hydroxide or potassium hydroxide.

4. The process as claimed in claim 1, wherein the pH is brought to a pH of 1.5 to 5 with an acid.

5. The process as claimed in claim 4, wherein the acid used is sulfuric acid, hydrochloric acid, acetic acid or formic acid.

6. The process as claimed in claim 1, wherein the reaction with base (D) takes place at 40° to 70° C.

* * * * *